US010669113B2

(12) United States Patent
Choplin

(10) Patent No.: US 10,669,113 B2
(45) Date of Patent: Jun. 2, 2020

(54) BUNDLE-WRAPPING FEEDSTOCK

(71) Applicant: C.E.R.M.E.X. Constructions Etudes et Recherches de Materiels pour l'Emballage d'Expedition, Corcelles-les-Citeaux (FR)

(72) Inventor: Gregory Choplin, Corcelles les Citeaux (FR)

(73) Assignee: SIDEL PACKING SOLUTIONS, Corcelles-les-Citeaux (FR)

( * ) Notice: Subject to any disclaimer, the term of this patent is extended or adjusted under 35 U.S.C. 154(b) by 183 days.

(21) Appl. No.: 15/581,087

(22) Filed: Apr. 28, 2017

(65) Prior Publication Data

US 2017/0313535 A1 Nov. 2, 2017

(30) Foreign Application Priority Data

Apr. 29, 2016 (FR) ..... 16 53868

(51) Int. Cl.

| | |
|---|---|
| ***B65H 19/18*** | (2006.01) |
| ***B65B 11/06*** | (2006.01) |
| ***B65B 41/16*** | (2006.01) |
| ***B65B 41/12*** | (2006.01) |

(52) U.S. Cl.

CPC ..... *B65H 19/1826* (2013.01); *B65B 11/06* (2013.01); *B65B 41/16* (2013.01); *B65H 19/1852* (2013.01); *B65H 19/1868* (2013.01); *B65B 41/12* (2013.01); *B65H 2301/413223* (2013.01); *B65H 2301/4621* (2013.01); *B65H 2301/4633* (2013.01); *B65H 2301/4634* (2013.01); *B65H 2301/46115* (2013.01); *B65H 2402/10* (2013.01); *B65H 2408/241* (2013.01); *B65H 2408/2411* (2013.01); *B65H 2701/1752* (2013.01); *B65H 2701/1944* (2013.01); *B65H 2801/81* (2013.01)

(58) Field of Classification Search

CPC ..... B65H 19/1826; B65H 19/1852; B65H 19/1863; B65H 19/1868; B65H 2402/10; B65H 2801/81

See application file for complete search history.

(56) References Cited

U.S. PATENT DOCUMENTS

| | | | | |
|---|---|---|---|---|
| 5,487,805 A | 1/1996 | Boriani et al. | | |
| 2004/0103977 A1 * | 6/2004 | Mace | ..... | B65H 19/1852 156/157 |

FOREIGN PATENT DOCUMENTS

| | | |
|---|---|---|
| CA | 2 021 164 A1 | 1/1991 |
| EP | 1 600 412 A1 | 11/2005 |
| EP | 1 379 457 B1 | 4/2006 |

(Continued)

OTHER PUBLICATIONS

French Search Report, dated Jan. 18, 2017, from corresponding FR application.

*Primary Examiner* — William E Dondero

(57) ABSTRACT

Disclosed is a feedstock device (1) to deliver film (2) to a bundle-wrapping machine and including, on the one hand, at least one reel (3) to receive a roll (4) of the film (2) to be delivered, and, on the other hand, a joining unit (5) to attach the next film (2) to the film (2) that is currently being fed. This device includes a support (6) on which the at least one reel (3) is mounted, with the support (6) being mobile in relation to the joining unit (5) to bring the delivered film (2) to the latter. The invention also has as its object a machine and a corresponding method.

14 Claims, 2 Drawing Sheets

(56) References Cited

FOREIGN PATENT DOCUMENTS

| | | | |
|---|---|---|---|
| GB | 1 417 972 | A | 12/1975 |
| GB | 2 080 256 | A | 2/1982 |
| WO | 02/083533 | A1 | 10/2002 |
| WO | 2010/121252 | A2 | 10/2010 |

* cited by examiner

BUNDLE-WRAPPING FEEDSTOCK

BACKGROUND OF THE INVENTION

Field of the Invention

This invention relates to the field of machines for packaging by bundle-wrapping, and has as its object, on the one hand, a device for feeding film, and, on the other hand, a method using this device, as well as a machine in which such a device is mounted.

Machines for packaging by bundle-wrapping continuously ensure, for products that are grouped together in batches, a wrapping using film dispensed from successive rolls. The machine is thus intended to operate continuously, with rolls whose sequencing must be ensured.

Description of the Related Art

In this field, EP1379457 discloses, for example, a feedstock roll switching method, in which a new film is engaged upon detection of the end of the unwound roll.

In the field of switching rolls, GB1417972 that proposes a supply device able to switch between an unwound roll and a reserve roll as a result of a rotating structure equipped with a pair of rollers between which the two films are placed is also known. An adhesive is placed on the reserve film in advance, making it possible to hook up the two films. Thus, the entrainment of the old film in the machine brings with it the new film, which guarantees the continuity of the process.

WO2010/121252 proposes, for the automatic switching between an unwound roll and a reserve roll, a tensioning roller against which the unwound film is wound after having separated the roll from the film portion taken into the machine. The tensioning roller is then pressed against the reserve roll, thus bonding, thanks to an adhesive provided in advance, the reserve film to the unwound film held on the tensioning roller. One of the drawbacks of this principle is that it changes the state of the film downstream from the switching, since it is necessary to wind a portion onto the tensioning roller.

CA2021164 proposes, in turn, to perform the switching between unwound roll and reserve roll by using two counter-rotating central rollers, on which a film is received each time. The films are stuck against one another in the area of these rollers thanks to a corresponding atomizer. One of the drawbacks of this operating principle is in particular that it cannot be extended to more than two rolls, which therefore limits the autonomy of the machine.

Finally, EP1600412 that proposes a principle based on a loading bar, mobile transversely to the bonding station between the reserve roll and the end of the reserve film, is also known. The two films are then bonded, against the loading bar. This implementation is, however, cumbersome, since it is necessary to modify the movement of the loading bar. In addition, the fastening of the reserve film changes with each cycle, which can lead to handling errors.

In view of this state of the art, a need exists to improve this kind of machine and in particular to increase its autonomy, while preserving its simplicity and its compatibility with rolls of defined size. One of the objects of the invention is thus to reduce the necessity for an operator to intervene on the machine to supply full rolls, or else to ensure their switching, etc. The machine should be able itself to ensure the sequencing of a group of rolls. The intervention of the operator should be reduced, for example, to a single installing operation for the whole group, which he will have prepared in advance.

SUMMARY OF THE INVENTION

To do this, the invention proposes bringing the rolls successively up to the area of a means for joining to the current film, for example a means for joining by heat-sealing.

The invention thus has as its object a feedstock device to deliver film to a bundle-wrapping machine and comprising, on the one hand, at least one reel to receive a roll of said film to be delivered, and, on the other hand, a joining means to attach the next film to the film that is currently being fed.

According to the invention, the feedstock device comprises a support on which the at least one reel is mounted, with said support being mobile in relation to the joining means to bring the delivered film to the latter.

The invention also has as its object a machine for producing units wrapped in a film, comprising a conveying means for said units, of the conveyor belt type, with the units being wrapped in successive sections of film, a machine that comprises, for the feeding of film, at least one feedstock device as described.

The invention also has as its object a method used by this device, namely a method of feeding film for a bundle-wrapping station from successive rolls, comprising stages consisting essentially in providing a film for the bundle-wrapping operation bonding to the provided film the film from the next roll, and then providing the film from said roll.

This method is characterized in that the roll is moved up to the area of a joining means so that its film is bonded there to the provided film.

BRIEF DESCRIPTION OF THE DRAWINGS

The invention will be better understood as a result of the description below, which is based on possible embodiments, explained in a way that is illustrative and not at all limiting, with reference to the accompanying figures, in which.

DESCRIPTION OF THE PREFERRED EMBODIMENTS

Figure 1:
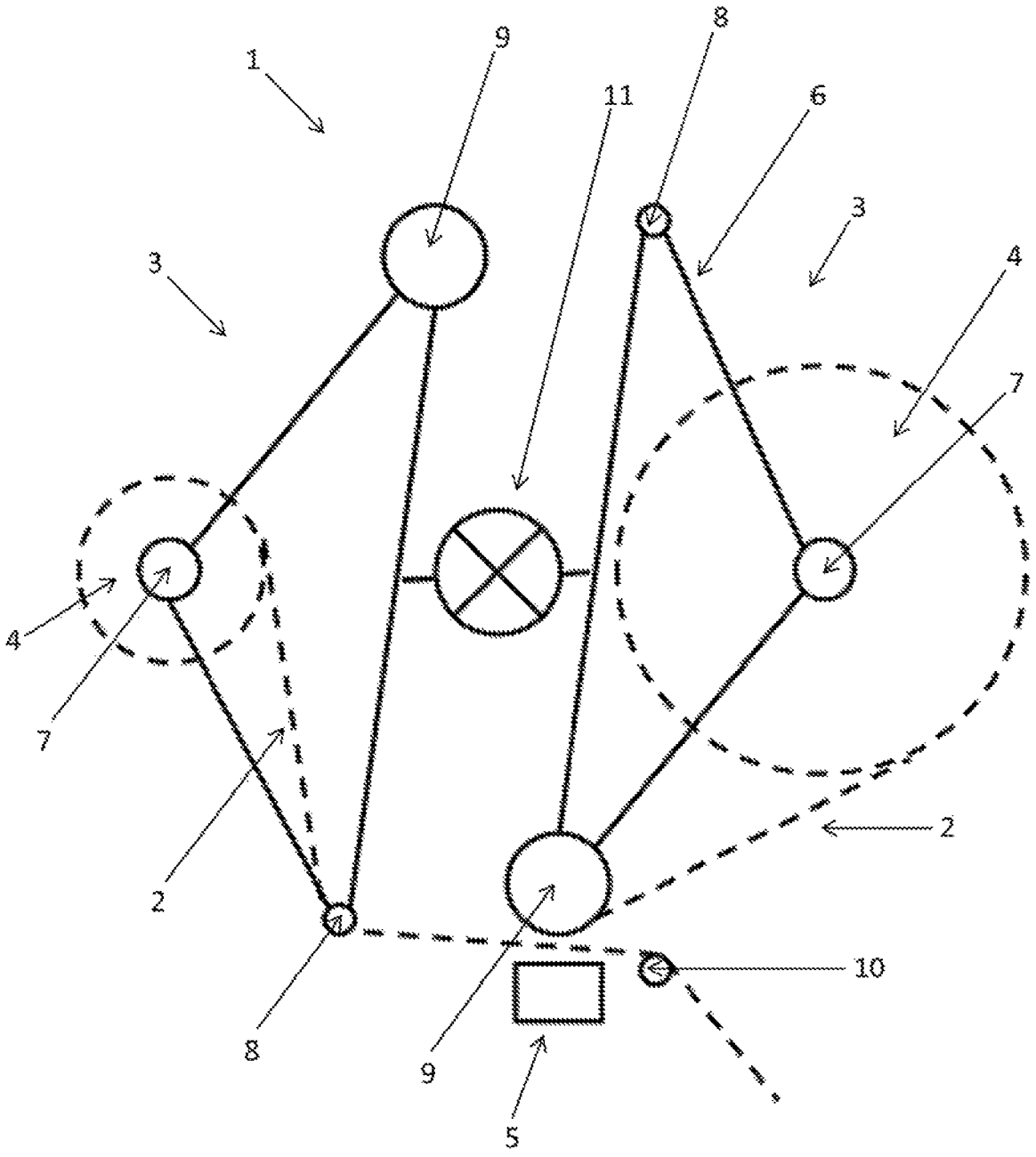
FIG. 1 shows an embodiment with a mobile support that can receive two rolls

The invention therefore first of all has as its object a feedstock device 1 for delivering film 2 to a bundle-wrapping machine and comprising, on the one hand, at least one reel 3 to receive a roll 4 of said film 2 to be delivered, and, on the other hand, a joining means 5 to attach the next film 2 to the film 2 that is currently being fed.

The bundle-wrapping machine in question normally works continuously while wrapping successive groups of products. These products can be organized in a matrix, with or without staggering. The successive bits of film 2 are used each time for one batch each. The machine is therefore fed continuously with film 2, for this wrapping operation. The feeding takes place from rolls 4 that it is then necessary to change: when a roll 4 is empty, it must be replaced by the next one, and this without discontinuity of feeding of the machine.

The joining means 5 thus serves to attach one to the other by heat-sealing, on the one hand, the film 2 from the next roll, and, on the other hand, the film in the machine. The current film 2 actually extends into the machine, and, to guarantee the continuity of the feed, i.e., to avoid a time-consuming stage for placing in the entire machine the film 2 along its path, the next film 2 is simply attached, by its downstream part, to the film 2 in the machine, in the area of its upstream part. Thus, as soon as the travel of the film 2 resumes, the new film 2 follows the routing directly in the machine. The new film 2 is thus easily inserted into the machine.

The feedstock device 1 can thus receive at least one roll 4 that delivers the current film 2, and at least one other reserve roll 4. Preferably, the feedstock device 1 can receive at least three rolls 4. For each roll 4, the feedstock device 1 is equipped with a reel 3. A reel 3 receives a roll 4 each time. The roll 4 has a central opening that makes it possible to be placed on a spindle 7 of the reel 3. The spindle 7 is free in rotation or optionally motorized to drive the roll 3 itself.

The products to be wrapped travel in a certain direction within the bundle-wrapping machine. It is in this direction that the film 2 must be delivered, and the axis of a roll 4 in the reel 3 is perpendicular to this direction of advance. The roll 4 therefore turns around an axis that extends into the width of the conveyance of products. An angled tool can also be used, in which case the axis of the roll can be different from the direction of advance of the products.

The joining means 5 makes it possible to bond the current film 2 and the next film 2, as will be described in detail below.

According to the invention, the feedstock device 1 comprises a support 6 on which the at least one reel 3 is mounted, with said support 6 being mobile in relation to the joining means 5 to bring the delivered film 2 to the latter.

The feedstock device 1 preferably is part of the bundle-wrapping machine and is positioned in particular under the travel plane of the products, or beside the conveyance. The device thus has a stationary part, forming a frame, in the machine. It also has a mobile support 6, preferably pivoting around an axis, optionally it too in the conveyance width of the products, and therefore parallel to the spindle of the reels 3, parallel, or parallel and even perpendicular to the conveyance in the case of resorting to an angled tool from a support 6 located outside of the bundle-wrapping station.

In the embodiments, which make possible increased autonomy, the mobile support 6 is not positioned under the conveyance plane, but beside the conveyance itself. The support 6 and the spindles that it carries, parallel to its axis of rotation, are then preferably parallel or perpendicular to the direction of conveyance of the products, angled tool rollers being provided to bring the film into the proper orientation, if applicable.

The mobile support 6 can take several different angular positions around its axis of rotation, each position corresponding to one of the reels 3 in a situation of feeding of film 2. The reels 3 are actually mounted on the support 6 and, thanks to the sequential rotation of the support 6, are presented by turns opposite a stationary part of the machine. The linking between the current film 2 and the next film 2 takes place in the area of this stationary part.

Thus, as a result of its mobility, the support 6 each time reaches a so-called joining position in which the delivered film 2 is found in the area of the joining means 5. As will be described farther on, in this joining position, not only the delivered film 2 but also the next film 2 are found opposite the joining means 5. The support 6 can therefore reach as many different joining positions as it has reels 3. To each one corresponds the provision by one of the rolls 4.

The joining means 5 therefore does not undergo the rotation of the support 6, but the latter is moved on itself to bring each time different films 2 in front of said means.

The support 6 can, for example, take the shape of a plate from which extend, cantilevered, all of the components of each reel 3, which again are described below: the spindle 7, the holding means 9, and the first roller 8. This plate is mounted to pivot in the machine, and can even be removed. A plate opposite can be provided to hold the elements at their other end.

According to a possible additional characteristic, the feedstock device comprises at least two reels 3 mounted on the support 6, so that the film 2 from one of the reels 3 can be delivered by the feedstock device 1 to the machine, the film 2 from the at least one other reel 3 that is on standby to replace it. The feedstock device 1 thus ensures the switching between two rolls 4. The number of reels 3 of the feedstock device 1 directly defines its autonomy. In preferred cases, the feedstock device 1 comprises at least three reels 3, even four. The reel 3 of the next roll 4 is thus preferably found, throughout the movement of the support 6, beside the reel 3 of the current roll 4: the joining means 5 will make possible the linking of the film 2 of the roll 4 of one reel 3 to the film 2 of the roll 4 of the reel 3 placed beside it in the support 6. The rolls 4 become by turns current roll 4, one after the other, in the order in which the reels 3 that carry them are placed on the support 6 and follow each other.

To go from a current roll 4 to the next current roll 4, the support 6 therefore performs a rotation, with the latter being always in the same direction. The support 6 therefore will have performed a complete revolution when it will have dispensed all of its rolls 4.

According to another possible additional characteristic, the feedstock device 1 is such that in one position of the support 6, both the delivered film 2 and the standby film 2 are in the area of the joining means 5, to be joined to one another, particularly the joining position. The film 2 that is currently being provided and the standby film 2 that must replace it therefore both come opposite the joining means 5. It will be noted that in the joining position, the current film 2 can nevertheless be in the process of traveling, and the machine can therefore be operating.

As the attached figures show, where the support 6 is each time in a joining position, both the current film 2 and the next film 2 are opposite the joining means 5. Thus, the movement of the support 6 to bring the current film 2 for heat-sealing is the same that brings the next film 2 to be heat-sealed. The feedstock device 1 is thus designed particularly for this purpose, in terms particularly of relative position of the reels 3, of geometric configuration of each reel 3, and/or of position of the support 6 relative to the joining means 5, etc. The same movement of the support 6 therefore brings for heat-sealing both the current film 2 and the next film 2, and this each time.

In certain embodiments of the invention, the at least one reel 3 comprises a spindle 7 onto which a roll 4 of film 2 can be slipped, a first roller 8 to guide the film 2 from said roll 4 when it is delivered by the feedstock device 1, as well as a holding means 9 to hold the free part of the film 2 when it is on standby.

The holding means 9 takes, for example, the form of a shaft to which the end of the film 2 can be attached, and around which said film 2 can be wound. The holding means 9 can be equipped with clamps or the like, to attach a portion of the end of the film 2. It is understood that when an operator installs a new roll 4 on a reel 3, he must slide the roll 4 onto the spindle 7, but also attach to the corresponding holding means 9 the free end of the film 2 of this same roll 4. The holding means 9 is preferably cylindrical and motorized for a winding of the film 2.

The holding means 9 comes in particular opposite the joining means 5 when the support 6 is in the joining position, so that the film 2 that is currently being distributed and the standby film 2 can be bonded by the joining means 5.

The joining means 5 is preferably in the form of a mobile heating element that simultaneously presses the distributed film 2 and the standby film 2 against the holding means 9. The joining means 5, on the one hand, and the holding means 9, on the other hand, therefore form clamps between which the two films 2 are taken and then pressed against one another.

The support 6 thus has several reels 3 of this configuration, placed successively after one another by a rotation by a predefined angle around the axis of rotation 11 of the support 6.

According to another possible additional characteristic, the feedstock device 1 comprises a second roller 10, stationary, against which the film 2 that is currently being fed travels. This roller 10 can be free in rotation around its axis, but its axis is preferably stationary in the machine.

As FIG. 1 shows in particular, the unwound film 2 travels with one of its sides against the first roller 8, its other side then traveling against the second roller 10. This second roller 10 makes possible the guiding of the film 2 that is fed, and this for each roll 4. Like the joining means 5, it does not follow the rotation of the support 6. Other than the slight movement of the joining means 5 toward the holding means 9 to perform the heat-sealing of the two films 2, the second roller 10 is stationary relative to the joining means 5.

According to another advantageous characteristic, the support 6 with the at least one reel 3 is a removable and interchangeable module, comprising in particular also the joining means 5. It is thus possible to load a support 6 with full rolls 4, to bond their film 2 to the corresponding holding means 9, even though the feedstock device 1 is in the process of production with another support 6 that is gradually emptying. The changing maneuver on the machine therefore is performed for a complete group of several rolls 4, on a support 6, and the changing time is therefore optimized.

The support 6, comprising several rolls 4, therefore becomes the unit to prepare and replace rather than the roll 4 alone. The support 6 can therefore be removed from the machine once it is empty, and a support 6 loaded with new rolls can be placed therein. This maneuver can be automated and performed by a robot, for example. It will be noted that it is not necessary that the supports 6 all have the same number of reels 3. The feedstock device 1 can be equipped with a locking system for a swiveling support 6. It is also preferably equipped with a motorization to make the support 6 turn. The locking system ensures the connection between the support 6 and this driving.

The support 6 therefore forms a removable module outside of the machine, and this module can optionally also comprise the joining means 5, in the form of a heat-sealing bar. Such a module is then able to feed a film continuously, by successive changing of the current roll 4, with the film 2 being bonded each time to the next film 2, etc.

The invention also has as its object a machine for producing units that are wrapped in a film 2, comprising a conveying means for said units, of the conveyor belt type, with the units being wrapped in successive sections of film 2.

The products are moved using a conveying element of the conveyor belt type, traveling in a normally horizontal plane. The film 2 is fed from underneath this plane, with the feedstock device 1 being under the plane or beside the conveyance.

According to the invention, the machine comprises, for the feeding of film 2, at least one feedstock device 1 as described above. In some configurations, the machine comprises several such devices. In particular, the feeding of the machine with film 2 can be performed as a result of an alternating from one and then the other feedstock device 1.

According to a possible additional characteristic of the machine, it comprises attachment means 12 to attach to the film 2 provided by the feedstock device 1 another film 2 provided by another source of film 2, for example in the form of another such feedstock device 1, with a support axis for roll 4, etc. In this type of embodiment, the machine therefore has several sources of film 2, at least one of which is a feedstock device 1 as described above. The film traveling in the machine and used to wrap the products comes by turns from one and then from another film source. The machine is then provided with a solution to bond the film from one of the sources to the film of the other source. A solution by heat-sealing is possible.

The machine is also provided with a means for halting the film 2 that is currently being distributed for the purpose of bonding it to the next film 2, and this even if the two films 2 are coming from two different sources. The feedstock device 1 preferably has such a halting solution, making it possible to hold the film 2 that is fed, in its traveling part in the machine, for the purpose of bonding the new film 2 thereto.

The invention also has as its object a method using the device as described above, namely a method of feeding film 2 for a bundle-wrapping station, from successive rolls 4, comprising stages consisting essentially in providing a film 2 for the bundle-wrapping operation bonding to the provided film 2 the film 2 from the next roll 4, and then providing the film 2 from said roll 4.

According to the invention, the roll 4 is moved up to the area of a joining means 5 so that its film 2 is bonded there to the provided film.

The actual bundle-wrapping operation is performed in the area of the travel plane of the products, and the film 2 is wrapped around batches of products. The film 2 is provided for this operation from a source that is the feedstock device 1 described above.

During the process, the rolls 4 are switched, i.e., the film 2 is fed by one of them and then by another, and so on.

To perform this switch, the roll 4 is moved up to a zone where its own film 2 is bonded to the current film. During this movement, the roll 4 moves, which means that its axis of symmetry also moves. It is moved until its film, the free end of which is attached to the holding means 9, comes opposite a joining means 5, where a heat-sealing can be performed.

In particular, the movement consists in moving a support 6 that comprises a reel 3 on which said roll 4 is mounted, particularly by moving it by rotation around an axis that is different from the one around which the roll 4 turns.

According to a possible additional characteristic, the roll 4 that is currently being fed and the next roll 4 are moved simultaneously so that their respective film 2 is brought to a joining means 5 to be joined there to one another, with the movement taking place in particular while the current roll 4, i.e., the one whose film 2 travels downstream in the bundle-wrapping machine, is in the process of production, and so that its film is therefore driven at a speed [sic]. The movement of the support, the consumption of film 2 by the machine, and the rotation of the current roll 4 are then preferably coordinated to maintain the necessary tension of the film.

Thus, the roll 4 can be in production even though it is not in position so that its film 2 is bonded to the next one. In this case, the film 2 cannot travel against the first roller 8 and/or against the second roller 10. The support 6 pivots while one of the rolls 4 is in production, and comes to a position where the film 2 in production travels against the first roller 8 and the second roller 10. The film 2 is then opposite the joining means 5. The same rotation or a rotation of additional distance then brings the film 2 of the next roll 4 likewise opposite the joining means 5. The assembly is then ready for the switching between the rolls 4 of the support 6.

In certain embodiments of the method, it comprises a loading stage during which at least one full roll 4 is installed on a mobile support 6 that ensures the subsequent movement of it up to the joining means 5. The support 6 is therefore at least partially accessible, while one of the rolls 4 is in distribution, so that at least one other reel 3 can receive a full roll 4. In the same way, at least one reel 3 is accessible to be able to remove the roll 4 to be taken off, because it is empty or otherwise. The full roll 4 can, generally, come onto the support 6 while it is mounted in the machine and during production, or also be installed on the support 6 when it, in the form of a removable module, is not in operation but separated from the machine.

Finally, according to a possible additional characteristic of the method, it comprises a loading stage, in the machine, of a support 6 that comprises numerous full rolls 4 and that is mobile to ensure their successive movement up to the joining means 5. Such a support 6 is therefore removable relative to the machine, and can be loaded with rolls 4 concurrently. Once it is loaded with full rolls 4, optionally different from one another, it can be installed in the machine. The new full support 6 can be mounted in another film source, or else be in place of the support 6 that is currently being supplied.

It will be noted that the full rolls 4 are not bonded to one another in the support 6, but that this bonding takes place only when the feedstock must be switched from one roll 4 to another. The changing of roll 4 takes place by replacing the film 2 that is currently being supplied with the film 2 from the roll from the reel 3 that follows.

In the embodiment illustrated in the accompanying figures, the machine in question ensures a bundle-wrapping operation. The processed products are containers, such as bottles, cans, or the like. The products are combined in a batch of rectangular or matrix shape, with the products being optionally staggered, in particular when it is a matter of products having a circular base. The batches are wrapped in a plastic film. They then go into a heated chamber, within which the films retract to press the products against one another and thus to form a free-standing unit. It is also conceivable that the film wraps several units of containers, each of the units itself being likewise already wrapped in a film.

The film in which the products are wrapped is fed by a roll 4 of film 2. Each wrapping is performed with a sheet of film 2, therefore a section of the film 2 dispensed by the roll 4 currently in use. The sheet is obtained by the cutting of the film 2 dispensed by the roll 4.

When the roll 4 is empty, it is therefore necessary to change the roll 4 and to continue to feed the production with film 2, but this from another roll 4.

The feedstock device 1 ensures the receiving and storage of several rolls 4 in the area of the bundle-wrapping machine. One of them is used to feed the production with film 2, which means that the film 2 wound on it travels into the wrapping station to come against the products. The at least one other roll 4 forms a reserve roll 4 on standby. When the current roll 4 is empty, or for other reasons, the feedstock is switched and a roll 4 previously on standby becomes the roll 4 that actually feeds the wrapping process.

For convenience, the roll 4 whose film is used for the production of packages is named current roll 4; the at least one other roll 4 is called standby roll 4, or reserve roll.

To avoid any interruption, the film from the standby roll 4 is bonded to the film of the current roll 4. A thermal bond can be used: since the films 2 are made of plastic, adding heat makes it possible to bond them. Preferably, the current roll 4 is stopped so that the film 2 is not moving at the place where it is bonded to the film 2 of the standby roll 4.

Solutions of the heat-sealing bar type are known and can be used here. The heat-sealing bar thus comprises two elements that extend along the width of the film 2. The film 2 of the current roll 4 and the film 2 of the standby roll 4, which will replace the current roll 4, are both taken between the two elements of the heat-sealing bar. The gap between these elements is then reduced with an addition of heat, so that both films 2 are pressed against one another while being heated and are then bonded to one another.

The feedstock device 1 is preferably placed in the lower part of the bundle-wrapping machine. The latter generally has a series of conveyor belts, to advance the products. The feedstock device 1 is then under the plane of these conveyor belts, which means that it receives the rolls 4 by placing them under the travel plane of the products.

Figure 2:
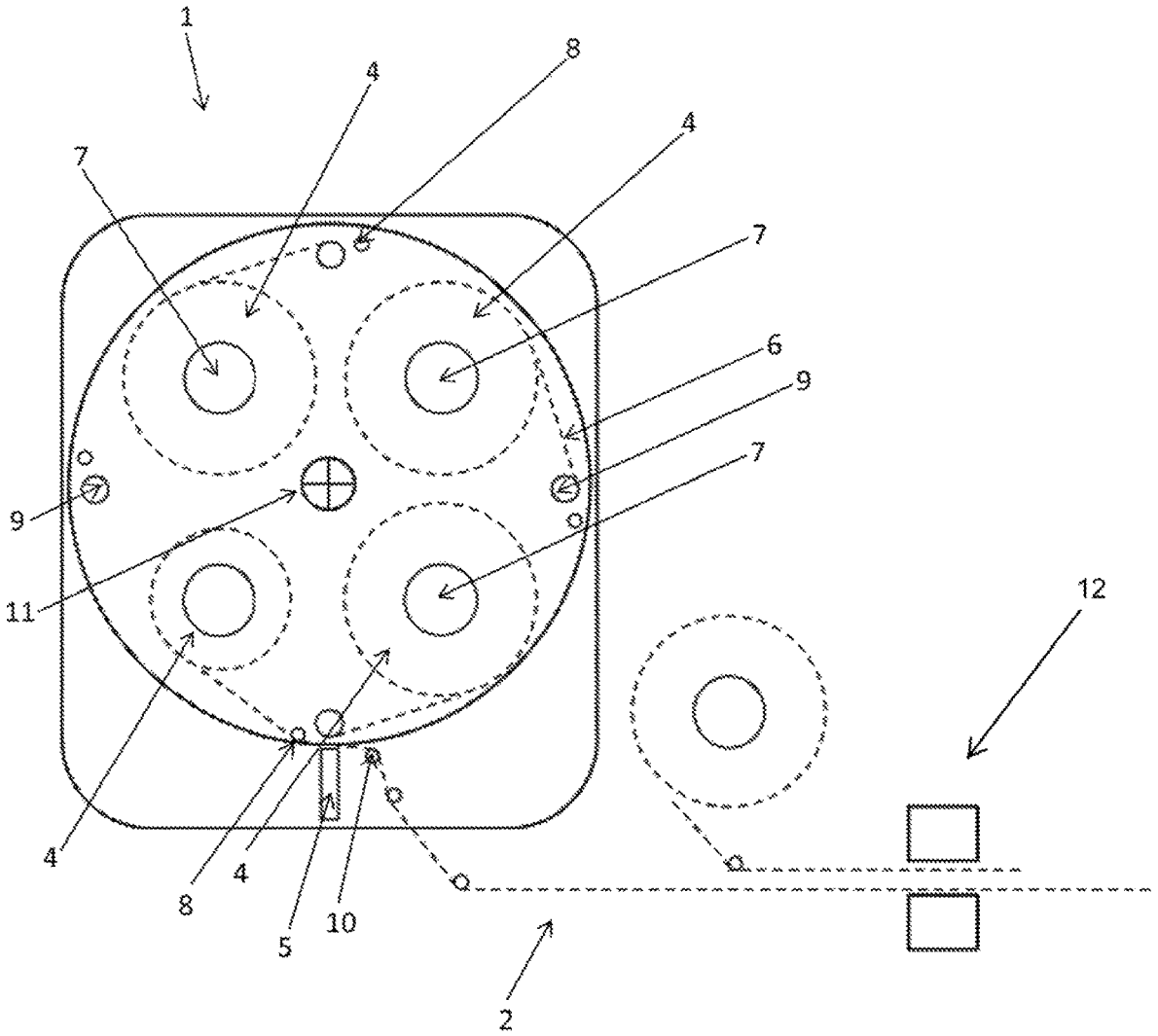
FIG. 2 shows an embodiment with a mobile support that can receive four rolls, with the machine having an additional feedstock of film.

As FIG. 2 shows, the feedstock device 1 can receive several rolls 4, each time on a suitable spindle 7, optionally a rotating spindle, free or driven.

The feedstock device 1 has a mobile support 6, on which all of its rolls 4 are received. The support 6 is mobile but the axes of the rolls 4 remain parallel to themselves during the movement of the support 6. Preferably, the support 6 is mounted with a freedom of rotation around an axis 11 that is parallel to the spindles for rolls 4, and therefore parallel to the axis of symmetry of the rolls 4 themselves, once placed on the support 6. This axis 11 of rotation of the support 6 extends into the width of the film 2.

FIG. 1 shows a support 6 that can receive two rolls 4; FIG. 2 shows, for its part, a support 6 that can receive four rolls 4.

Associated with each roll 4 is a reel 3, mounted on the support 6. A reel 3 comprises a spindle 7, essentially cylindrical in shape and onto which a roll 4 with a hollow center can be slipped. The spindle 7 takes the form of a shaft, optionally motorized in a way that is synchronized with the machine's requirement for film 2.

The reel 3 also comprises a holding means 9, to hold the free portion of the film 2 of the associated roll 4. The holding means 9 can take the form of a shaft, or roller, at the periphery of which the film 2 can be attached, for example taken between said shaft and a counter-plate held against the shaft by magnetic action. Different ways to bond the film 2 to this cylindrical shaft are conceivable. If necessary, a rotation of the holding means 9 around its own axis so that the film 2 covers a portion of the periphery is conceivable. Preferably, the film 2 does not cover the entire periphery of the holding means 9.

Finally, the reel 3 comprises a first roller 8, against which the film 2 can travel once the roll 4 is used as current roll 4. As the figures show, the first roller 8, which guides the film 2 when it supplies the machine, and the joining means 5, which holds the film 2 as long as its roll 4 is on standby, are separated by the spindle 7 that is found between them. More specifically, in possible embodiments, the first roller 8 is found on one side of the plane defined by the axis of rotation 11 of the support 6 and the axis of the spindle 7, with the holding means 9 being found on the other side.

The film 2 is therefore first of all taken into the holding means 9, as long as its roll 4 is a reserve roll that does not feed the machine. Once the roll 4 is the current roll 4, its film 2 travels against the first roller 8. During the switching, the roll 4 that becomes the current roll 4 is disengaged from the end taken into the holding means 9 and engaged with the film feeding the machine.

Thus, the rolls 4 that are on standby have their film 2 attached to the holding means 9 of the corresponding reel 4 [sic]. As regards the current roll 4, it is no longer bonded to the holding means 9 but its film 2 is dispensed into the machine and therefore travels against the first roller 8. Generally, the roll 4 mounted on a reel 3 therefore has its film 2 either that travels against the first roller 8 when it is the current roll 4, or that is held by its end in the holding means 9 when it is a reserve roll 4. As it is already described elsewhere, the roll 4 can feed even though the support 6 is not in the position that brings its film against the first roller 8.

The feedstock device 1 also comprises a joining means 5, which contributes to bonding one to the other, on the one hand, the film 2 from the current roll 4, and, on the other hand, the film 2 from the reserve roll 4 that will follow it. This joining means 5 ensures a pressing of the films 2 against one another and/or an addition of heat. After its action, the film 2 of the roll 4 that must become the current roll 4 is attached to the film 2 that travels downstream in the bundle-wrapping machine, until the wrapping. The possible pull of the film 2 from a downstream portion therefore has the effect of bringing the film 2 from the new roll 4 into the machine.

The joining of the two films 2 is based on the principle of heat-sealing, and is therefore performed by adding heat while the two films 2 are against one another. Preferably, in the area of the junction of films 2, the preceding current roll 4 is separated from the portion of film 2 that travels into the machine, so that only the film 2 from the future current roll 4 is bonded to this portion.

The support 6 is mobile in relation to the joining means 5, to bring opposite it successively the films 2 to be bonded for an automatic switching of the rolls 4 guaranteeing the continuity of the feed.

The joining means 5 preferably comprises a mobile heating element. This element extends through the width of the film 2 and preferably over its entire width. It is mobile in a plane perpendicular to the axis along which it extends. Thus, the support 6, by its successive movements each time in the area of the joining means 5, brings along both the film 2 of the current roll 4 and the film 2 of the standby roll 4 that replaces it, with the latter being held by the holding means 9. Thus, the holding means 9 of the reel 3 of the next roll 4 is brought, by the rotation of the support 6, opposite the joining means 5. The latter is then moved to be brought against the holding means 9, with, between them, the current film 2 and the film 2 of the standby roll 4.

The feedstock device 1 is also equipped with a second roller 10, which does not follow the movement of the support 6. This second roller 10 contributes to guiding the current film 2, and is therefore found normally downstream from the first roller 8 of the reel 3 whose roll 4 is the current one. Thus, the film 2 of the current roll 4 travels successively against the first roller 8, opposite the joining means 5, and then against the second roller 10. In a position of the support 6 ready to heat-seal the two films 2 together, the holding means 9 of the reel 3 carrying the standby roll 4 that will then be the current roll 4 is likewise itself found near the joining means 5, with the current film 2 traveling between them.

The switching of roll 4 will now be described in a more detailed way.

In the starting position of a switch, the support 6, on which the reels 3 are mounted, is positioned so that the holding means 9, which attaches the film 2 of the reserve roll, is found opposite the joining means 5. Between the holding means 9 and the joining means 5 are found, on the one hand, the film 2 of the current roll 4, and, on the other hand, the film 2 of the standby roll 4 that will replace it. Actually, the latter film 2 is at least partially wound around the holding means 9 in the form of a shaft and therefore covers it for a portion of its periphery.

The current roll 4 is stopped so that the two films 2 are then stationary opposite the joining means 5: the film 2 of the current roll 4 and the film 2 of the standby roll 4 that is to replace it.

The joining means 5 then approaches the holding means 9 then forming a counter-stop. The two films 2 are then pressed between these two means that form jaws. Adding heat at this time and at this site ensures the sealing of the two films 2 to one another, by a bond of the heat-sealing type.

After this heat-sealing, the joining means 5 separates from the holding means 9, and a configuration is obtained where a film 2 extends, downstream from the heat-sealing obtained, up into the machine ensuring the bundle-wrapping, and, upstream, up to each of the two rolls 4, namely the current roll 4 and the reserve roll 4 that will replace it.

A rotation of the spindle 7 of the reserve roll 4, in the direction opposite that which is used to feed the machine, makes it possible to disengage the film 2 fed into the machine from the current roll 4. This rotation can be performed while the joining means 5 is still pressing the two films 2 against the holding means 9. Other movements to achieve this separation are conceivable.

It is also conceivable to perform two successive heat-sealings, separated by a rotation of the rolls 4, with the first ensuring the mechanical strength between the film of the reserve roll 4 and the current film for feeding into the machine. In addition, it is preferable to equip the machine with a halting device, which acts downstream from the joining means 5.

A double heat-sealing can be obtained in the following way. The feedstock device 1 is equipped with a tensioner of film 2, which acts downstream from the heat-sealing zone. The dispensed film is then halted downstream from the tensioner. Before the first heat-sealing, the tensioner comes into operation so as to cause a slight length of additional film to be released from the current roll 4, upstream from the halting device. The first heat-sealing is performed, and then the tensioner is retracted. It is then possible to perform a rewinding to wind up into the heat-sealing zone the film 2 that the tensioner has previously released. The second heat-sealing can then be performed on a portion of film that is downstream in relation to that where the first heat-sealing was performed. It then remains to rewind the emptied roll 4 to tear off the discard of film 2.

Once the new roll 4 has turned a few degrees in the direction opposite to that of the feed, its film 2 becomes the only one bonded to the portion in the machine. A restarting of the machine, which therefore pulls the film 2 from this roll 4 that has become the current roll 4, makes it possible to continue the feeding of film 2. The starting of the machine is accompanied by the coordinated operation of the appropriate spindle 7.

At this stage, the roll 4 that was the current roll 4 is bonded to the holding means 9 of the reel 3 that carries the roll 4 that has become the current roll 4. The film 2 of the roll that was the current roll 4 is therefore found against the first roller 8 of the reel 3 that carries it, and is bonded, following at least one heat-sealing performed by the joining means 5, to an end of film 2 that belonged to the other roll 4 and that is wound on the holding means 9 of the reel 3 that carries said other roll 4, henceforth the current roll 4.

The support 6 can then be placed in rotation for the next switch. During this rotation, the film 2 of the current roll 4 is brought against the first roller 8. The support 6 is turned so that the spindle 7 of the reel 3 of the current roll 4 goes beyond the joining means 5. Thus, the film of the current roll 4 comes against the joining means 5, guided between, on the one hand, the first roller 8, mounted on the support 6, and on the other hand, the second roller 10.

Ultimately, the position of the support 6 is such that the holding means 9 of the next standby roll 4 likewise itself comes opposite the joining means 5. Attained then at this stage is the starting configuration, from which a new switch can be performed, namely: the two films 2, the one from the current roll and the one from the reserve roll 4, are between, on the one hand, the joining means 5 and, on the other hand, the holding means 9 of the reel 3 of the standby roll 4. The position of the film 2 of the current roll 4 against the joining means 5 is ensured by the first roller 8 of the same reel 3 as well as by the second roller 10, bonded to the structure relative to which the support 6 turns. The position of the film 2 of the next standby roll 4 is ensured by the relative position, on the support 6, of the spindle 7 of the next standby roll 4 and of the corresponding holding means 9, namely by the configuration of the reel 3 of the next standby roll 4.

It will be noted that the placing of the support 6 in rotation until reaching the position in which the next switch will be performed can take place even once the machine has restarted, i.e., once the current roll 4 dispenses film 2 for the wrapping. It is therefore conceivable that for a more or less long part, the film of the current roll 4 travels neither against the first roller 8 nor against the second roller 10, but is only brought there at the time of a switch.

The support 6 can therefore have numerous reels 3 arranged star-like from its axis of rotation 11. For each switch, the support 6 advances by one step, this step representing the angular spacing between two reels 3. The support 6 can therefore take the shape of a drum, which turns by a predefined angle for each switch of rolls 4. The autonomy is therefore at least the sequence of all of the rolls 4 on the support 6. This support 6 always turns in the same direction to bring a new roll 4 each time.

Once all of the rolls 4 of the support 6 have been emptied, a changing operation must be performed. A loading of a full roll 4 on an operating support 6 must preferably take place once the support 6 is stopped in its rotation.

The support 6 with its reels 3 can, for example, be in a module that can be removed and separated from the feedstock device 1 and from the machine in which it is installed. When a support 6 is empty, a full support 6 is loaded, i.e., loaded with rolls 4 that are all full.

The unloading of the empty support 6 and the loading of a full support 6 can take place automatically, for example, with a robotic solution. The movement of the supports 6 can take place as a result of autonomous carriages. The installation of the supports 6 on the machine can take place in a robotized way. The full support 6 can have been prepared by an operator during a production time, and therefore in concurrent operation time. The preparation of a full support 6, with a full roll 4 in each reel 3, comes down, for the operator, to placing a roll 4 on each spindle 7, and then in attaching the free end of its film 2 to the corresponding holding means 9, namely a clamp or the like.

The removable and interchangeable module can optionally comprise the joining means 5, indeed also the second roller.

It will be noted that the installation of full rolls 4 can take place as a unit. Thus, it is possible to remove an empty roll 4 and put on a new full roll 4, at the same time as the machine is in production and therefore as a roll 4 is delivering film. It is thus possible for an operator to organize the resupplying of roll 4 in a more flexible way.

Further, in certain configurations, the wrapping or bundle-wrapping machine has several possible feeds of film 2, of which at least one of them is provided by a feedstock device 1 that is described. Thus, when a support 6 is entirely empty, or when it must be changed or switched for other reasons, such as a change of format, the machine can switch to another source of film 2 than that of the feedstock device 1. This second source of film 2 can have an autonomy similar to the support 6 described above. This second source can also have a lesser autonomy, being used then only to ensure the continuity of the feed of film 2 when a support 6 is removed and another is installed.

A principle of joining by heat-sealing can also be used between the film traveling in the machine and either the film of this at least one other feedstock or the film leaving the feedstock device 1.

As a result of the invention, it is thus possible to supply a bundle-wrapping machine with film 2, and this with increased autonomy. The invention can be adapted for feedstock devices 1 that receive a very large number of rolls 4 and that have them intervene sequentially in an autonomous way. The intervention times of the operator are reduced. Since several rolls 4 can be linked and each empty roll 4 can be replaced individually, the operator can organize his interventions on the machine in a more flexible way. The replacement for a full roll 4 can be performed at different times.

Although the above description is based on particular embodiments, it in no way limits the scope of the invention, and modifications can be made, particularly by substitution of technical equivalents or by a different combination of all or part of the characteristics developed above.

The invention claimed is:

1. A feedstock device (1) to deliver film (2) to a bundle-wrapping machine, the feedstock device comprising:

at least one reel (3) to receive a roll (4) of said film (2) to be delivered;

a joining means (5) to attach a next film (2) to the film (2) that is currently being fed; and a support (6) on which the at least one reel (3) is mounted, said support (6) being mobile in relation to the joining means (5) to bring the delivered film (2) to the joining means (5), and said support (6) with the at least one reel (3) is a removable and interchangeable.

2. The feedstock device according to claim 1, wherein the feedstock device comprises at least two reels (3) mounted on the support (6), so that the film (2) from a first reel (3) can be delivered by the feedstock device (1) to the bundle-wrapping machine, with the film (2) from a second reel (3) being on standby to replace the film (2) from first reel (3).

3. The feedstock device according to claim 2, wherein the feedstock device (1) is such that in one position of the support (6), both the delivered film (2) and the standby film (2) are in the area of the joining means (5), to be joined to one another.

4. The feedstock device according to claim 3, wherein the first reel (3) and/or the second reel (3) comprises a spindle (7) onto which a roll (4) of film (2) can be slipped, a first roller (8) to guide the film (2) from said roll (4) when the film (2) is delivered by the feedstock device (1), as well as a holding means (9) to hold a free portion of the film (2) when the film (2) is on standby.

5. The feedstock device according to claim 3, wherein the feedstock device comprises a second roller (10), stationary, against which the film (2) that is currently being fed travels.

6. The feedstock device according to claim 2, wherein the first reel (3) and/or the second reel (3) comprises a spindle (7) onto which a roll (4) of film (2) can be slipped, a first roller (8) to guide the film (2) from said roll (4) when the film (2) is delivered by the feedstock device (1), as well as a holding means (9) to hold a free portion of the film (2) when the film (2) is on standby.

7. The feedstock device according to claim 2, wherein the feedstock device comprises a second roller (10), stationary, against which the film (2) that is currently being fed travels.

8. The feedstock device according to claim 1, wherein the at least one reel (3) comprises a spindle (7) onto which a roll (4) of film (2) can be slipped, a first roller (8) to guide the film (2) from said roll (4) when the film (2) is delivered by the feedstock device (1), as well as a holding means (9) to hold a free portion of the film (2) when the film (2) is on standby.

9. The feedstock device according to claim 8, wherein the feedstock device comprises a second roller (10), stationary, against which the film (2) that is currently being fed travels.

10. The feedstock device according to claim 1, wherein the feedstock device comprises a second roller (10), stationary, against which the film (2) that is currently being fed travels.

11. A machine for producing units wrapped in a film (2), configured to receive said units from a conveying means with the units being wrapped in successive sections of film (2), and for the feeding of film (2), at least one feedstock device (1) according to claim 1.

12. The machine according to claim 11, wherein the machine comprises attachment means (12) to attach to the film (2) provided by the feedstock device (1) another film (2) provided by another source of film (2).

13. A method of feeding film (2) for a bundle-wrapping station, from successive rolls (4), comprising:

providing a first film (2) of a first roll (4) for the bundle-wrapping operation, bonding to the first film (2) a second film (2) of a second roll (4), providing the film (2) from the second roll (4), and loading a mobile support (6) comprising numerous full rolls (4) to ensure successive movement of the numerous full rolls (4) up to a joining means (5); wherein the second roll (4) is moved up to the area of the joining means (5) so that the second film (2) is bonded there to the first film (2).

14. The method according to claim 13, wherein the roll (4) that is currently being fed and the next roll (4) are moved simultaneously so that their respective film (2) is brought to the joining means (5) to be joined there to one another.

* * * * *